US009751003B2

(12) United States Patent
Stanton

(10) Patent No.: US 9,751,003 B2
(45) Date of Patent: Sep. 5, 2017

(54) SIX-PIECE COORDINATED MOTION PUZZLE

(71) Applicant: Raymond Stanton, Alameda, CA (US)

(72) Inventor: Raymond Stanton, Alameda, CA (US)

(73) Assignee: Raymond Stanton, Alameda, CA (US)

( * ) Notice: Subject to any disclaimer, the term of this patent is extended or adjusted under 35 U.S.C. 154(b) by 68 days.

(21) Appl. No.: 14/809,037

(22) Filed: Jul. 24, 2015

(65) Prior Publication Data

US 2016/0023096 A1 Jan. 28, 2016

Related U.S. Application Data

(60) Provisional application No. 62/029,216, filed on Jul. 25, 2014.

(51) Int. Cl.
*A63F 9/12* (2006.01)

(52) U.S. Cl.
CPC .... *A63F 9/1208* (2013.01); *A63F 2009/1228* (2013.01)

(58) Field of Classification Search
CPC ..... A63F 9/1208; A63F 2009/1228
See application file for complete search history.

(56) References Cited

U.S. PATENT DOCUMENTS

| | | | | |
|---|---|---|---|---|
| 4,153,254 | A | 5/1979 | Marc | |
| 4,198,053 | A | 4/1980 | Rao | |
| 4,880,238 | A | 11/1989 | Derouin | |
| 5,040,797 | A * | 8/1991 | Dykstra | A63F 9/12 273/160 |
| 5,722,657 | A | 3/1998 | Cabrera | |
| 5,762,336 | A | 6/1998 | Miller, Jr. | |
| 2009/0079131 | A1 * | 3/2009 | Hsieh | A63F 9/1208 273/160 |

* cited by examiner

*Primary Examiner* — Gene Kim
*Assistant Examiner* — Jeffrey Vanderveen
(74) *Attorney, Agent, or Firm* — Quine Intellectual Property Law Group, P.C.; Gary Baker, Esq.

(57) ABSTRACT

This invention provides paired structures that can be combined in sets of three pairs in an assemblage exhibiting a three-dimensional coordinated motion during assembly and disassembly. The assemblage can be used as an entertaining puzzle providing challenging assembly and unexpected coordinated expansion of all parts on disassembly. The puzzle includes six pieces shaped such that when completely assembled all pieces form an interlocking assembly that can only be assembled or disassembled when all six pieces aligned correctly and moved simultaneously in a specific coordinated motion.

14 Claims, 7 Drawing Sheets

SIX-PIECE COORDINATED MOTION PUZZLE

RELATED CASES

The present application is a utility application claiming benefit of U.S. Provisional Patent Application No. 62/029,216, filed Jul. 25, 2014.

FIELD OF THE INVENTION

The present inventions are in the field of three dimensional mutually interlocking structures that expand or contract in a coordinated motion. Such structures have utility in the mechanical arts. Further, such assemblages are of value in the intellectual and entertainment arts, e.g., as puzzles and art works.

BACKGROUND OF THE INVENTION

"Put together, take apart" puzzles are a general category of three-dimensional puzzles that consist of two or more pieces that interlock in some manner, and are a challenge to assemble and/or disassemble. Put together, take apart puzzles that primarily consisting of notched sticks, interlocked to form three-dimensional structures, can be referred to as "burr" puzzles. Some prior art burr puzzles are solved by sequentially moving one piece at a time with respect to the other pieces until the puzzle is assembled or disassembled. These puzzles can be referred to as "sequential motion" burr puzzles.

A second category of burr puzzles can demonstrate the simultaneous movement of all, or several pieces, of the puzzle in a coordinated manner to assemble or disassemble the puzzle. These can be referred to as "coordinated motion" burr puzzles. There are prior art coordinated motion puzzles that use three pieces, and some puzzles that use four pieces.

Star burr puzzles are constructed of three pairs of parallel pieces with one pair aligned with the X-axis, one pair aligned with the Y-axis and one pair aligned with the Z-axis in such a way that they interlock into one assembled puzzle. Starr burrs puzzles have often appear as jagged spheres or crystals and can include a simple coordinated motion on assembly or disassembly. The external shape of star burr puzzles when fully assembled can be constructed to take many forms, including an outward form similar to that shown in FIG. 7 when fully assembled. Often, all six pieces have the identical shape and topography. During the coordinated motion of disassembly for star burr puzzles capable of coordinated motion, each pair of parallel pieces is simultaneously pulled directly (in one direction) apart from the other piece in the pair, and directly away from the center of the assembly until the pieces no longer interlock. During this coordinated motion, the pieces in each pair away from each other only in one plane with respect to each other. For example, see the partially disassembled star burr of FIG. 7.

Certain patented puzzles may be worth mentioning as background to the different present puzzles. U.S. Pat. No. 4,153,254, Puzzle, to Marc, is a typical take apart, put together three-dimensional puzzle. This puzzle has several different pieces and assembles into multiple shapes. It does not allow coordinated motion during assembly or disassembly. U.S. Pat. No. 4,880,238, Locking Puzzle, to Derouin, is a typical put together, take apart interlocking "burr" puzzle made from sticks with notches. This puzzle has many different shaped pieces and is incapable of coordinated motion. U.S. Pat. No. 4,198,053, Mortised Block Puzzle, to Rao, is a put together, take apart puzzle that forms an assembly that has one piece along each of the X, Y and Z-axes. This puzzle only has three pieces and it does not utilize coordinated motion. U.S. Pat. No. 5,722,657, Irregular Polyhedron Puzzle Game with Pieces of Asymmetrical Shapes, to Cabrera, is a take apart, put together puzzle in which the assembled puzzle has a general shape with portions aligned with the X, Y and Z axis, but it has very many pieces with very different geometry and it does not utilize coordinated motion. Cabreras' puzzle is actually based on Rubic cube technology. U.S. Pat. No. 5,762,336, Three Dimensional Interlocking Puzzle, to Miller, is also a put together; take apart interlocking puzzle that has components generally configured along the X, Y and Z-axes when assembled. The pieces are generally circular and it does not allow coordinated motion.

It would be desirable to have a puzzle with a simpler array of components. Because of the difficulty and surprising appearance of coordinated motion puzzles, it would be interesting to have a puzzle with a different motion, obscured internal mechanism, and challenging assembly requirements. Benefits could be derived from an assembly that expands or contracts in three dimensions, e.g., when force is applied to as few as two parts. It would also be rewarding to have a coordinated motion puzzle structured to allow the outward appearance to be modified while retaining the function of the coordinated motion mechanism. The present invention provides these and other features that will be apparent upon review of the following.

SUMMARY OF THE INVENTION

The invention, in one aspect, is a three-dimensional puzzle including six separate pieces that are each constructed in such a manner that they can only be put together and taken apart to form the interlocking assembly by utilizing a unique form of simultaneous coordinated motion. The geometry of the six pieces is such that during assembly all are simultaneously placed in exactly the correct starting position, and then moved simultaneously in a specific coordinated motion to form the interlocking assembled puzzle. Similarly, the assembled puzzle can be disassembled by reversing the same unique and simultaneous coordinated motion.

When fully assembled, the puzzle consists of, e.g., two parallel pieces that are aligned along the X-axis, two parallel pieces that are aligned along the Y-axis, and two parallel pieces that are aligned along the Z-axis such that all parallel pairs appear to intersect in the geometric center of the puzzle. See FIG. 1, Puzzle Fully Assembled.

The puzzle can provide a unique coordinated motion for assembly and disassembly. During assembly and disassembly, each piece can interface (e.g., in slidable surface contact) with four of the other five pieces, and during movement each piece slides across the surface of the other four pieces at four interface regions. As assembled pieces are pulled apart via the coordinated motion, the assembly begins to expand as the pieces slide over each other. See FIG. 2, Puzzle in the Process of Being Disassembled. Considering the motion of the pair of vertical pieces (assembly Y-axis), as the puzzle is expanded during the process of disassembly, the two pieces are moved away from each other through a depth, and they also moved laterally (X-axis) with respect to each other, and they also moved vertically (Y-axis) with respect to each other. The other two pairs of pieces (those along the X-axis and Z-axis) also move in a similar fashion with respect to their associated pair member. This unique motion is unexpected and difficult for the puzzle solver to anticipate and visualize, making the puzzle challenging.

The interacting structures of a 3D coordinated motion assembly can include, e.g., a piece A having a longitudinal Y-axis, a first end part and second end part, each part comprising a square cross-section perpendicular to the Y-axis. The first end part can include a slide surface in an X/Z-axis plane. First and second triangular surfaces (e.g., from a pyramidal extension) can extend down, e.g., generally in the direction of the lower slide surface. The assembly can further comprise a piece B comprising a three dimensional mirror image of piece A, particularly with regard to the slide surface and triangular surfaces. Piece A/piece B pairs can be configured to allow three pairs to slidably engage and simultaneously collapse into an interlocked assembly in a coordinated motion with each piece A triangular surface in slidable contact with another piece A triangular surface, and each piece B triangular surface in slidable contact with another piece B triangular surface. The pieces can be adapted so that first triangles slidably contact second triangles from another piece (of same chirality, left or right) in the assembly, but first triangles do not slidably contact first triangles from another piece in the assembly.

In some embodiments, the internal working structures of the pieces can be described as a solid combination of well understood 3-dimensional geometric structures. For example, a piece A can include integrated geometric solids, in interfaced integrated sequential order: a first cube, a second cube, a first triangular prism, a second triangular prism, a third triangular prism, and a pyramid. The prisms can act as a strut fixing the relationship between the sliding surfaces of the cubes (and lower end part) and the pyramid faces (triangular surfaces). The first and second cubes are aligned together in an x-axis with the first and second triangular prisms aligned in the y-axis. The third triangular prism can extend from the second triangular prism in the z-axis, with the pyramid extending from the third prism in the x-axis presenting first and second triangular surfaces, e.g., generally toward the center of the piece. In the arrangement, the second cube can be to the left of the second cube, the first triangular prism on top of the second cube, the second of the triangular prism on top of the first prism, the third triangular prism forward of the second prism, and with the pyramid to the right of the third prism. The strut parts, e.g., cubes and prisms, do not have to be flat faced 3D geometric solids, but can have any shape and cross-section providing the strut function of, e.g., holding the sliding interfaces (particularly the lower end part lower slide surface, lower cube side slide surface, and triangular surfaces of the pyramid) in functional relative orientations. The integrated geometric solids can be unitary and fabricated by, e.g., carving the unitary solids from a solid media, casting, and injection molding, and/or the like. The space outside the integrated cubes, prisms and pyramid in the X and Z directions can be unoccupied by solid material. The pyramids can have at least one pair of surfaces each including one or more angular edge intersection and with the surfaces coming together at a 45 degree angle. In an exemplary embodiment, the piece A cubes, prisms, and pyramid are arranged as illustrated in FIG. 5 or FIG. 6.

In another example, the first triangular prism and second triangular prism are each covered with an identical notch-fill prism to provide two cubes. That is, that part of the strut can have a square cross section. In one visual representation such puzzle pieces, the cubes, prisms and pyramid can be arranged as illustrated in FIG. 3 or FIG. 4.

In many cases piece A has outer lateral surfaces that fit inside a rectangular prism containment having a square cross-section with a width of D. Many of the piece A internal working surfaces would be in parallel surface contact with the inside of a rectangular prism. In fact pieces A can be carved out of square stock materials. In many such embodiments, the cube structures are each one half the width (½ D) of such a rectangular prism. Each of the prisms and pyramid in these embodiments will typically have at least one edge of length ½ D. Further, the outward axial extension of the pieces, end parts can also have a square cross section, e.g., of D width and depth (at least within the regions presenting sliding contact surfaces).

In many embodiments, a top surface 80 of the first cube of piece A can be arranged in the same plane and one cube width away from the third triangle edge 81 furthest from the second triangle in piece B, as shown in FIG. 8. The present invention includes piece A/B pairs as illustrated in FIG. 8, and their equivalents, configured to allow coordinated motion assembly of three such pairs, each pair aligned in a different X, Y, or Z axis. For example, see the arrangement as illustrated in FIG. 1 or FIG. 2. The coordinated motion of the six pieces, on assembly or disassembly can comprise relative motion between each pair member in all three dimensions.

As discussed herein, the outward extensions (e.g., generally, axially away from the center) of end parts are free to have any desired topography, ordaining the outward appearance of the puzzle. End parts can be integrated at the bottom and top of piece A and/or piece B pair members and the end parts can be adapted to provide a desired outward appearance to the assembled assembly. The outward extensions or pieces and pairs do not have to be identical. For example, the overall outward appearance of the assembly can optionally include shapes such as a sphere, a dodecahedron, a cube, a crystal, a star, a machine, a part of an animal, a part of a plant and/or the like.

DEFINITIONS

Before describing the present invention in detail, it is to be understood that this invention is not limited to particular devices or biological systems, which can, of course, vary. It is also to be understood that the terminology used herein is for the purpose of describing particular embodiments only, and is not intended to be limiting. As used in this specification and the appended claims, the singular forms "a", "an" and "the" include plural referents unless the content clearly dictates otherwise. Thus, for example, reference to "a surface" can included a combination of two or more surfaces; reference to "metal" can included mixtures of metals, and the like.

Unless defined otherwise, all technical and scientific terms used herein have the same meaning as commonly understood by one of ordinary skill in the art to which the invention pertains. Although any methods and materials similar or equivalent to those described herein can be practiced without undue experimentation based on the present disclosure, preferred materials and methods are described herein. In describing and claiming the present invention, the following terminology will be used in accordance with the definitions set out below.

Directions used to describe puzzle pieces are based on a three dimensional grid. For example, a Piece A (left hand piece) internal structures can be described according to geometric structures in laid out (with certain surface faces in contact) along X, Y, and Z coordinates, as is understood in the art. In the discussion, left and right can be used to designate relative X-axis positions, up (above) and down (below) relative Y-axis positions, and front and back for relative Z-axis positions.

As used herein, "integrated" refers to the different 3D geometric shapes having a unitary construction. For example, a pair of cubes of the same size stacked face to face can form a single rectangular prism. Typically the stacked shapes are formed (e.g., carving out) from the same piece of material or as the same piece of material (molding of casting). These unitary structures are integrated. Optionally, the integrated structure can be multiple separate objects (cubes, prisms, pyramids) assembled and fixed together.

As used herein, "coordinated motion" refers to motion of one puzzle piece depending on the motion of another puzzle piece. That is, the motion of a first piece depends on the concurrent motion of another puzzle piece. For the six piece puzzle described herein, due to the mutual surface contact interactions of the six pieces at once, the progressive motion of each piece depends on the coordinated motion of all pieces.

The term "mirror image" is as known in the art. Mirror images provide bilateral symmetry. The pieces can be arranged on two sides of a plane and any point defined in three dimensions has a corresponding point equidistant and at the same angle from the plane. For example, see mirror image left and right pieces in FIG. 9.

The term "edge" is as known in the art and ordinarily used. An edge can be the outer extent of a planar surface, or the angular intersection of one surface with another. For example an edge can be defined by a straight or curving line where an object or area begins or ends.

"End parts", as used herein are the parts on the Y-axis ends beyond the interior working parts and surfaces. For example the end parts can be visible in the fully assembled version of the basic puzzle model of FIG. 1. In particular, the end parts include the parts below the sliding surface 42, and non-working (e.g., no sliding contact surface) parts above the top triangular surface edge.

The puzzle is "interlocked" when assembled and remains so until any one piece can be removed from the assembly without moving another piece.

DETAILED DESCRIPTION

The coordinated motion puzzle includes three pairs of mirror image left and right pieces. This can include three left pieces and three right pieces. The pieces include internal structures that interact to interlock all six pieces together, when assembled. The internal structures also interact so that when the puzzle is disassembled all pieces more away from each other in a coordinated motion, with paired left and tight pieces moving away from each other in all three dimensions. The puzzle cannot be disassembled one piece at a time.

Figure 2:
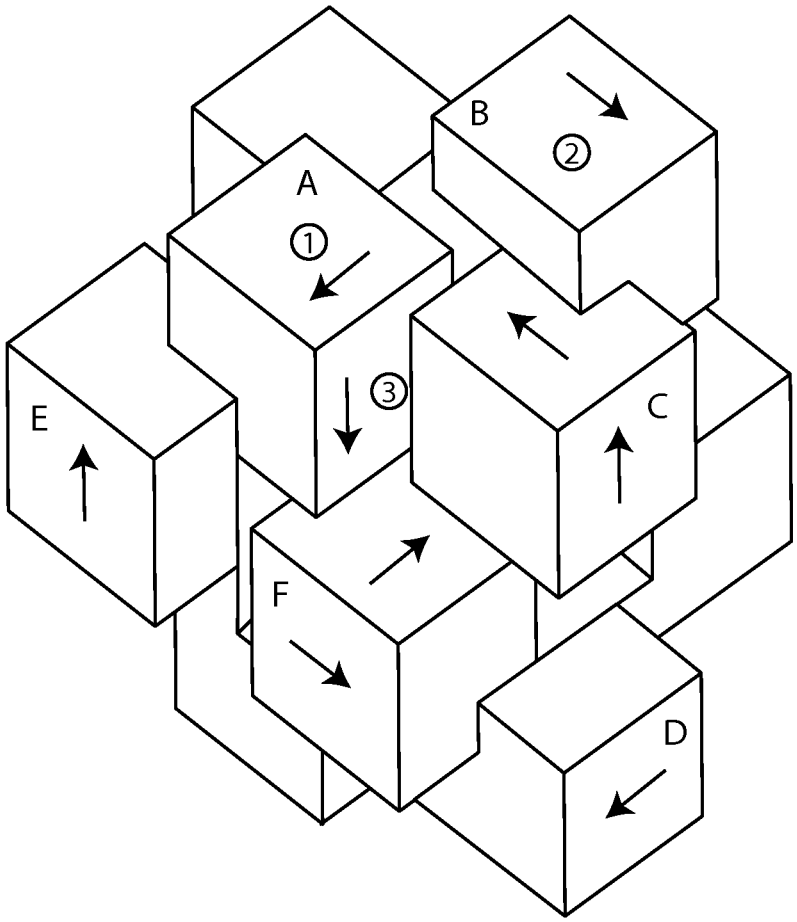
FIG. 2 is a schematic diagram of a six piece coordinated motion puzzle with arrows representing motions of pieces during the process of disassembly.

This inventive structures provide for simultaneous motion of all six pieces in a specific, unique, and coordinated manner to assemble and disassemble the puzzle, and thus can be classified as a "coordinated motion" burr puzzle. This invention differs from prior art puzzles at least because the geometry is based on six pieces rather than three or four, and requires all six pieces to achieve the necessary coordinated motion for solution of the puzzle. Such a puzzle differs from prior art, e.g., because during the coordinated motion of the invention, each piece of each pair is not only moved away from their paired piece, but they are moved laterally with respect to each other, and they are moved vertically with respect to each other, and as a result of these additional directions of motion the pieces do not move directly away along a single axis of the puzzle. See FIG. 2, puzzle partially disassembled. The method of achieving this relative motion of the pieces in this invention is unique among all prior art coordinated motion puzzles.

The Assembled Six-Piece Puzzle

In use as a coordinated motion puzzle, there are three pairs of mirror image pieces. A piece A ("left") has a longitudinal Y-axis with a first end part and second end part which can comprise square cross-sections perpendicular to the axis. The first end part can comprise a slide surface in an X and Z-axis plane, and the second end part comprise a pyramidal extension down and presenting first and second triangular "interlocking" surfaces, e.g., generally directed toward the slide surface. The piece B ("right") can comprise essentially a three dimensional mirror image of piece A, or comprise at least a mirror image with regard to the internal working contact surfaces.

In an assembly of three piece A/piece B pairs, the slide surface of a first piece A can slide across the strut section (e.g., cubes 3 and 4; mid-section of piece) of a second piece A running perpendicular to the first piece. Further, the slide surface of the second piece A can slide across the strut section of a third piece A running perpendicular to the second piece; and, the slide surface of the third piece A can slide across the strut section of the first piece A running perpendicular to the third piece.

In a similar fashion, in an assembly of three piece A/piece B pairs, the slide surface of a first piece B can slide across the strut section of a second piece B running perpendicular to the first piece. The slide surface of the second piece B can slide across the strut section of a third piece B running perpendicular to the second piece; and, the slide surface of the third piece B can slide across the strut section of the first piece B running perpendicular to the third piece.

On assembly, the pairs of A and B pieces are adapted to slidably engage and simultaneously collapse into an interlocked structure in a coordinated motion with each piece A pyramidal extension in slidable contact with each other piece A pyramidal extension, and each piece B pyramidal extension in slidable contact with each other piece B pyramidal extension.

A notch between the first and second end parts can be adapted to closely fit and slidably receive the body of a second end part from another perpendicular A/B piece pair. For example, the second end part of a piece A from a first A/B pair can slide into the piece B notch of a second A/B pair; the second end part of the piece B can slide into the piece A notch of the third A/B pair; the second end part of that piece A can slide into the piece B notch of the first A/B pair; the second end part of that piece B can slide into the piece A notch of the second A/B pair; the second end part of that piece A can slide into the piece B notch of the third A/B pair; and finally, the second end part of that piece B can slide into the piece B notch of the first A/B pair.

So, in the assembled, collapsing, or expanding puzzle, the first end part slide surface contacts (slidably) the strut of another (A to A, B to B) piece; the piece A pyramids slidably contact each of the other A pyramids; the piece B pyramids slidably contact each of the other B pyramids; and the second end part fits slidably in the notch (e.g., at the strut) of another (A to B, B to A) piece.

Pieces A and B

The working section (e.g., between the end parts) of a piece A (also called the left piece) can generally be describes as a rectangular prism with a square cross-section and with certain portions removed to present notches and slidable surfaces for interaction with other pieces. Piece B is generally a mirror image of piece A, particularly with regard to contact surfaces, such as the lower end part slide surface, strut notch, and pyramid faces.

Figure 4:
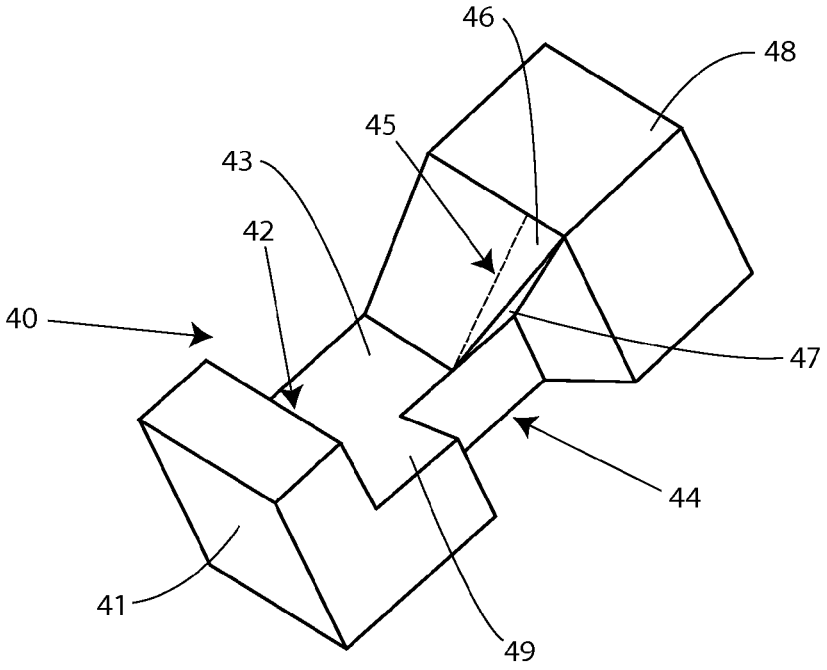
FIG. 4 is a schematic diagram of a left hand (piece A) puzzle piece, e.g., wherein the strut structure has a square cross-section.

Piece A 40, in an embodiment shown in FIG. 4, includes end part 41, bottom slide surface 42, strut 43, strut notch 44, pyramid 45 (with pyramid faces 46 and 47), and second (upper) end part 48.

Figure 1:
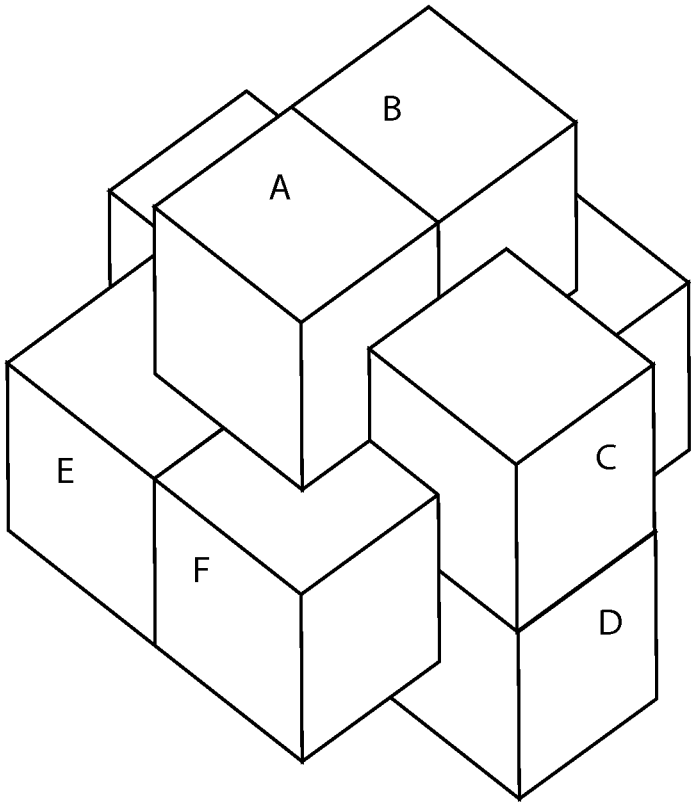
FIG. 1 is a schematic diagram of a fully assembled six piece puzzle.

The end parts (particularly the bottom of the bottom end part, and top of the top end part) are typically beyond the sliding interactions of the inner working parts and can take on ornamental topography. In the example of FIG. 1, the faces of the end parts (identified with alphabet characters) in an assembled puzzle are simply flat faces continuing the square cross section of the functionally interacting end parts. Alternatively, it is envisioned that the extensions of the end parts can have shapes to provide a variety of outward appearances. The end parts could have outward extensions, avoiding the slidably interacting surfaces of the working parts that meet to present almost any 3D geometric, natural, artistic, or fanciful shape. For example, the end parts could expand out to meet beyond the working parts, contacting to form an outer surface of a sphere, cube, star, dodecahedron, sport ball, bust of George Washington, etc.

The bottom slide surface is typically in a plane (X-Z plane) perpendicular to the axis of the piece. The bottom slide surface can meet a strut slide surface 49 (in the X-Y plane; sides of cubes 1 and 2, in the example of FIG. 4), which also interacts with the strut section of a perpendicularly oriented second piece A. These slide surfaces, along with, e.g., the interaction of the second (top) end parts in their respective strut notches, align the triangular faces of triplet A or B pyramids to contact and slidably interact.

The strut connects, orients and spaces, e.g., the lower sliding surfaces to functionally interact with the contact and sliding surfaces of the pyramid. The strut connecting the top and bottom end parts can have any shape or cross section appropriate to accomplish the connecting, spacing, and orientation functions. In the present examples of FIGS. 5 and 6, the main body of the strut has a triangular cross section. This is a convenience and artifact of the elected method of manufacture for the part. For example, while machining the pyramid face 47, it can be easier to continue the cut through at a 45 degree angle while also cutting notch 44 (see FIG. 5). In other embodiments, the strut can have a square cross section, e.g., as in FIGS. 3 and 4. Having a flat Y-Z plane at the notch can allow more smooth sliding contact with the bottom slide surface of another piece, while also presenting a more entire surface appearance in disassembly. Alternately, the strut structure can be any appropriate structure (e.g., with any cross section) that fixes the relationship between the slide and pyramid, e.g., and presents a surface or edge upon which the lower slide surface can slide.

The pyramid for each piece can extend from a strut surface (or upper end part surface) to interact with corresponding pyramids of two other pieces of the came chirality (left or right). A pyramid can conveniently extend from a triangular prism extending forward from a strut. The pyramid triangular face 46 can be an extension left of the longest third prism surface. The piece element is called a pyramid because if it were cut from the triangular prism and top part of the FIG. 4 or 6 piece, it could be described as a pyramid having a right angle and 4 total faces. Two faces are attachment points to the end part and strut Important aspects of the pyramid are the exposed faces 46 and 47, which include surfaces that come into slidable contact with pyramids of two other pieces. The main point of such contact for each pyramid is the narrowest half of each exposed pyramid face.

A complete puzzle assembly includes three pieces A and three pieces B. A piece B is a functional bilateral mirror image of a piece A. That is, e.g., whereas the strut and outer end parts of pieces may differ, functional slide parts and pyramid faces of A and B pieces are typically 3-dimensional mirror images of each other.

Materials and Dimensions

The present puzzles are interlocking three-dimensional puzzles, typically with solid sliding contact surfaces and dimensioned for manual manipulation.

Puzzle pieces are typically manufactured out of wood, stone, metal, plastic, glass, ceramic, and/or the like. For wood, metal, or stone, the puzzle pieces are commonly carved from rectangular prism "square stock" starting material. For certain metal, glass, plastic, or ceramic, the pieces can be molded to form solid pieces with acceptable dimensional tolerances.

To simplify preparation of many sliding surfaces, and to provide an attractive look, the pieces are often configured with dimensions that fit within a hollow rectangular prism, e.g., defined by the cross section of the end parts. This particularly in the regions between any surfaces that slidably interact with an end parts sliding contact surface. However, as discussed above, regions of the pieces extending beyond the functionally interacting parts can take on any topography not interfering with function of the coordinated motion mechanism.

The pieces can have a length of less than 1 centimeter (cm) to more than a meter, from 2 cm to 150 cm, from 4 cm to 30 cm, from 5 cm to 15 cm, or about 8 cm. This can be the same for the average diameter of the assembled puzzle. The width or depth of the pieces, e.g., at the end part cross-section, can range from of less than 3 millimeters (mm) to 300 cm or more, from 5 mm to 50 cm, from 10 mm to 10 cm, from 1.5 cm to 5 cm, or about 2 cm.

EXAMPLES

The following examples are offered to illustrate, but not to limit the claimed invention.

Example 1—Simple Six Part Coordinated Motion Puzzle

A puzzle was fabricated comprising of six pieces to be put together and taken apart through the use of a unique process of simultaneous coordinated motion. The six separate pieces were each generally shaped like an elongated bar having a generally square cross section, and each bar has specially designed notches formed such that the six separate pieces can be assembled into a single interlocking puzzle. Three of the six pieces are identical to each other and will be referred to as "right hand" pieces. The other three pieces are also identical to each other, but the design is opposite hand to that of the first three pieces, and they will be referred to as "left hand" pieces. When the puzzle is fully assembled, one pair of pieces (consisting of one right hand piece and one left hand piece adjacent to each other) is aligned along the X-axis (horizontal axis), and a second pair of pieces is aligned with the Y-axis (vertical axis), while the remaining pair of pieces is aligned with the Z-axis (front to back axis), with the three pairs of pieces appearing to intersect in the geometric center of the puzzle. See FIG. 1: Puzzle Fully Assembled.

Figure 3:
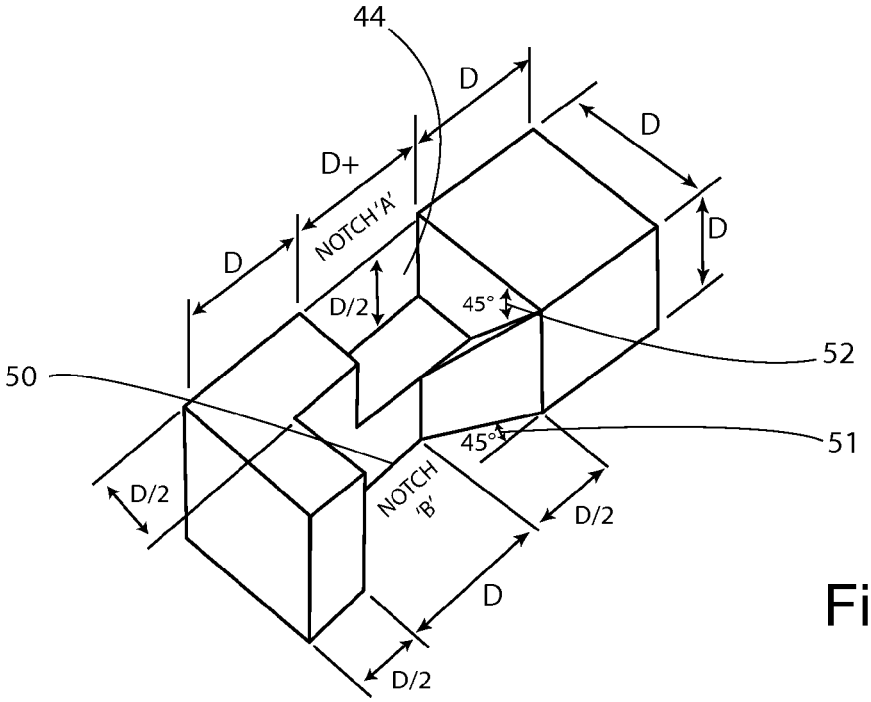
FIG. 3 is a schematic diagram of a right hand (piece B) puzzle piece, e.g., wherein the strut structure has a square cross-section.

The geometry of the notches in each piece is such that all the pieces can interlock without interference in a completed assembly. The pieces are also configured so that they can be put together through a unique process of simultaneous coordinated motion that can only be initiated when all six pieces are each positioned in the right starting position. The right hand pieces with notches are shown in FIG. 3, and the left hand pieces are shown in FIG. 4. This embodiment is based on bars having a square cross section with a dimension of D. Notch A 44 is slightly larger than D to allow for sliding, and its depth is ½ D. Notch B 50 width is 1 D, and its depth is ½ D. Angle 1 51 and angle 2 52 are both at 45 degrees.

Figure 5:
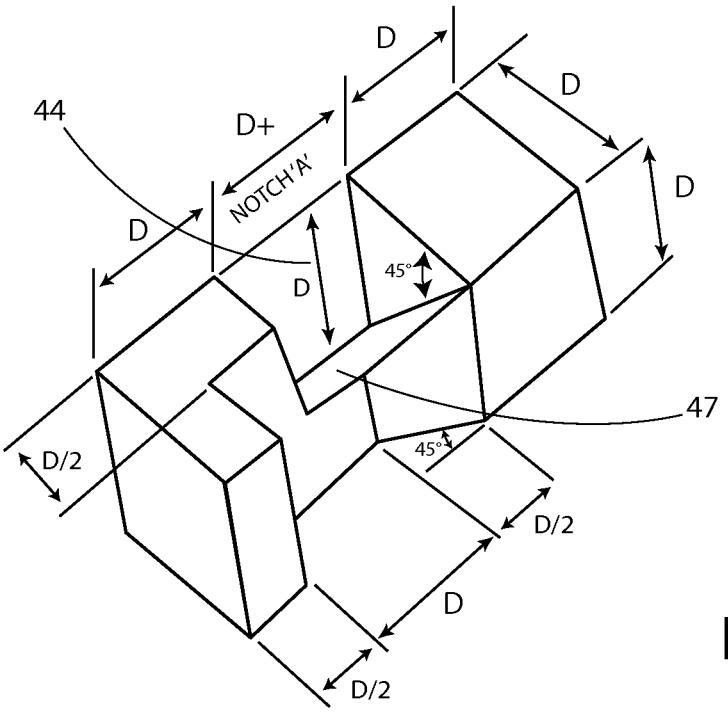
FIG. 5 is a schematic diagram of a right hand (piece B) puzzle piece, e.g., wherein the strut structure has a triangular cross-section.
Figure 6:
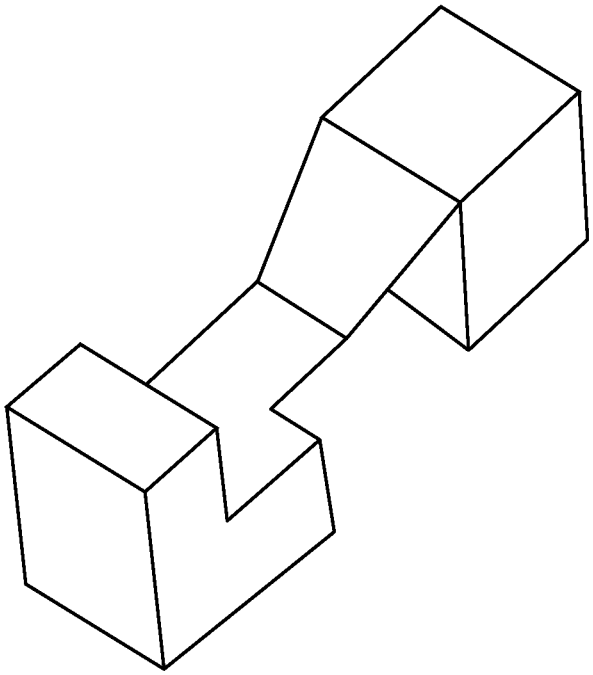
FIG. 6 is a schematic diagram of a left hand (piece a) puzzle piece, e.g., wherein the strut structure has a triangular cross-section.
Figure 7:
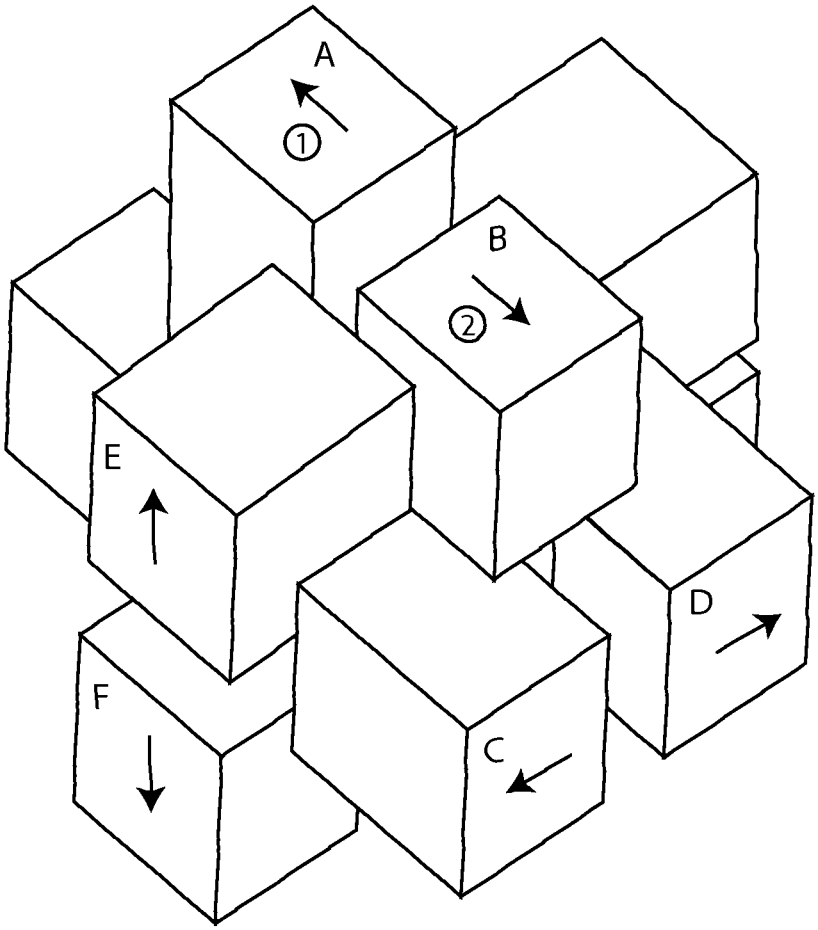
FIG. 7 external shape of old art star burr puzzle having only linear motion of pieces on assembly and disassembly.
Figure 8:
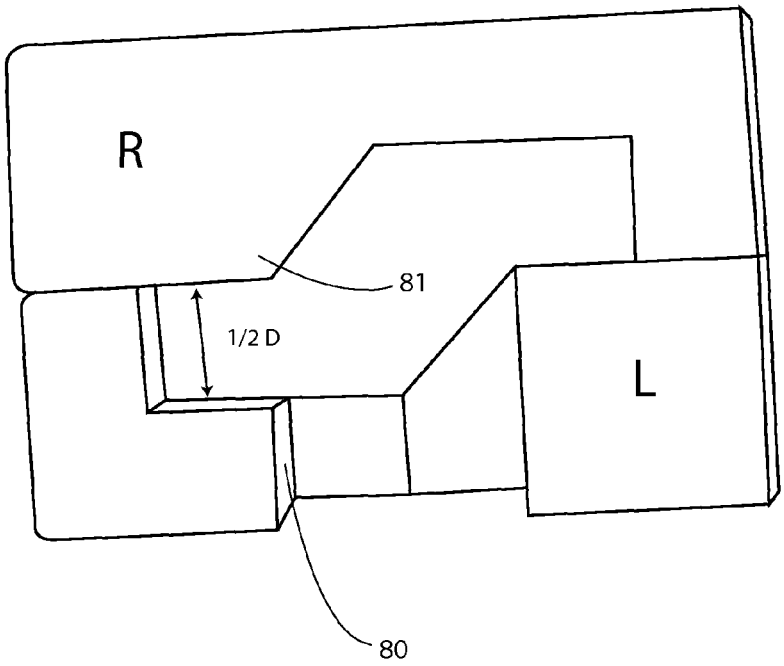
FIG. 8 shows a left piece and right piece pair oriented together as they are along one axis of a triple pair assembly.
Figure 9:
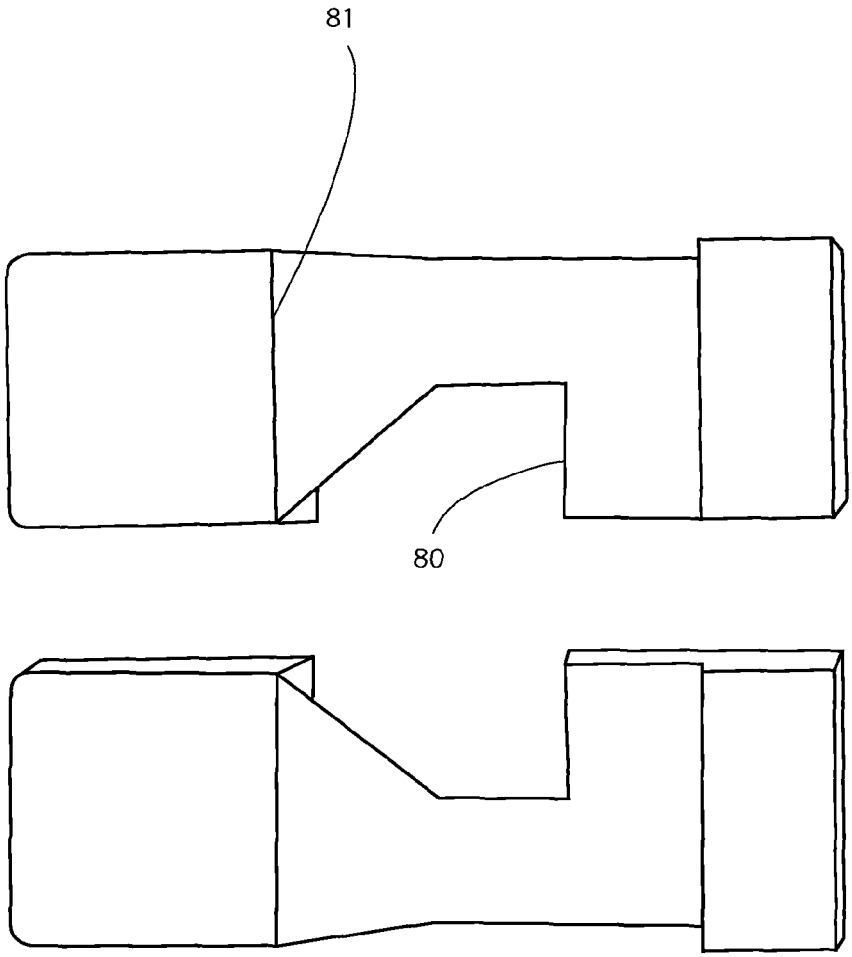
FIG. 9 shows a pair of mirror image pieces.

FIGS. 5 and 6 show right and left hand pieces with an alternative notch design that is easier to manufacture if machining is involved. The only difference is that notch A 44 is cut all the way through the piece. The coordinated motion is the same with this design and the exterior appearance is also the same when fully assembled, but the sliding action is may not be as smooth because the complementing strut must slide across an edge instead of a flat surface.

It is understood that the examples and embodiments described herein are for illustrative purposes only and that various modifications or changes in light thereof will be suggested to persons skilled in the art and are to be included within the spirit and purview of this application and scope of the appended claims.

While the foregoing invention has been described in some detail for purposes of clarity and understanding, it will be clear to one skilled in the art from a reading of this disclosure that various changes in form and detail can be made without departing from the true scope of the invention. For example, all the techniques and apparatus described above can be used in various combinations. All publications, patents, patent applications, and/or other documents cited in this application are incorporated by reference in their entirety for all purposes to the same extent as if each individual publication, patent, patent application, and/or other document were individually indicated to be incorporated by reference for all purposes.

What is claimed is:

1. Interacting structures of a coordinated motion assembly, comprising:

a piece A having a longitudinal Y-axis, a first end part and second end part each part comprising a square cross-section perpendicular to the axis; wherein the first end part comprises a slide surface in a X and Z-axis plane, and wherein a first triangular surface and a second triangular surface extend down from the second end part; and, the piece A comprises integrated geometric solids including, in order: a first cube, a second cube, a strut, and a pyramid; wherein with the first and second cubes are aligned together in an x-axis, the strut is aligned in a y-axis, and the pyramid extends from the strut or second end part presenting downward the first and second triangular surfaces, and the second cube is to the left of the first cube, the strut is on top of the second cube, and the pyramid is to the right of the strut, and the prisms and pyramid each have at least one pair of surfaces that come together at a 45 degree angle;

a piece B comprising a three dimensional mirror image of piece A with regard to the slide surface and triangular surfaces;

wherein piece A and piece B are configured to allow three piece A/piece B pairs to slidably engage and simultaneously collapse into an interlocked assembly in a coordinated motion with each piece A triangular surface in slidable contact with another piece A triangular surface, and each piece B triangular surface in slidable contact with another piece B triangular surface;

wherein the coordinated motion assembly comprises three piece A/piece B pairs arranged at 90 degrees to each other about a common center.

2. The structures of claim 1, wherein the pieces are adapted so that first triangles slidably contact second triangles from another piece in the assembly, but first triangles do not slidably contact first triangles from another piece in the assembly.

3. The structures of claim 1, wherein the first end part or second end part is described by a rectangular prism or cube.

4. The structures of claim 1, wherein the piece A second end part square cross-section has side dimensions of D units and the piece A fits inside a rectangular prism containment having a square cross-section with a width of D.

5. The structures of claim 4, wherein each of the two cubes has a width of ½ D, and pyramid has at least one edge of length ½ D.

6. The structures of claim 1, wherein piece A cubes, strut, and pyramid are arranged as illustrated in FIG. 5 or FIG. 6.

7. The structures of claim 1, wherein piece A cubes, strut, and pyramid are arranged as illustrated in FIG. 3 or FIG. 4.

8. The structures of claim 1, wherein a top surface of the second cube of piece A is in the same plane and one cube width away from an upper edge of the piece B pyramid.

9. The structures of claim 1, wherein the integrated geometric solids are unitary and fabricated by a method selected from the group consisting of: carving the unitary solids from a solid media, casting, and injection molding.

10. The structures of claim 1, wherein space outside the integrated cubes, strut, and pyramid in the X and Z directions are unoccupied by solid material.

11. The arrangement of claim 1, wherein end parts are integrated at the bottom and top of piece A or piece B pair members and the end parts are adapted to provide a desired outward appearance to the assembled assembly.

12. The arrangement of claim 11, wherein the outward appearance is selected from the shapes consisting of: a sphere, a dodecahedron, a cube, a crystal, a star, a machine, a part of an animal, and a part of a plant.

13. The arrangement of claim 1, wherein the coordinated motion comprises relative motion between each pair member in all three dimensions at once.

14. The structures of claim 1, wherein the first and second triangular surfaces meet at an angle of 45 degrees.

* * * * *